United States Patent [19]

Parente

[11] 3,992,901

[45] Nov. 23, 1976

[54] NECKLACE WITH OVERLAPPING ANNULAR MEMBERS AND STRING-CONCEALING MEMBERS

[75] Inventor: Michael Parente, New York, N.Y.

[73] Assignee: Theresa Hammer, New York, N.Y.

[22] Filed: Apr. 23, 1975

[21] Appl. No.: 570,597

[52] U.S. Cl. ..... 63/2

[51] Int. Cl.[2] ..... A44C 25/00

[58] Field of Search ..... 63/2, 3, 5 A, 11; 29/433; 2/300, 311

[56] References Cited

UNITED STATES PATENTS

| | | | |
|---|---|---|---|
| 1,894,195 | 1/1933 | Pulver | 63/2 X |
| 3,742,730 | 7/1973 | Powell | 63/2 X |
| 3,765,376 | 10/1973 | Higgins | 63/2 X |

FOREIGN PATENTS OR APPLICATIONS

| | | | |
|---|---|---|---|
| 689,745 | 6/1930 | France | 63/2 |
| 1,460,161 | 10/1966 | France | 63/2 |

*Primary Examiner*—F. Barry Shay

[57] ABSTRACT

An ornamental necklace made up of annular members in combination with beadlike elements wherein the annular members are disposed in alternating overlapping relation together with stringing means or the like for maintaining the annular members in their overlapping relation; the beadlike elements being disposed within and/or between successive annular members in the stringing means and concealing such stringing means, the relationship of the beadlike elements and the annular members being such that the necklace may be worn to expose either side thereof to thereby provide alternative ornamental effects.

8 Claims, 5 Drawing Figures

NECKLACE WITH OVERLAPPING ANNULAR MEMBERS AND STRING-CONCEALING MEMBERS

BACKGROUND OF THE INVENTION

Ornamental necklaces are commonly made up of pierced beadlike elements with simple stringing to interconnect the successive beadlike elements. While some variations may be obtained by using beadlike elements of differing materials, sizes, colors and individual configurations; the ornamental effects are derived primarily from basic stringing arrangements. Obviously, this is not conducive to attaining elaborate designs and intricate effects.

Also, in most cases, the stringing means must be essentially concealed, which imposes limitations on the configurations of the beadlike elements making up the necklace. This in turn limits possible variations in the overall ornamental designs.

Accordingly, an object of this invention is to provide an improved necklace construction which is based essentially on annular members and beadlike elements associated therewith; the character of the annular members being of unlimited configurations, colors, materials and relative disposition and the disposition of the beadlike elements selectively relative to the annular members, being such as to allow for practically unlimited designs and ornamental effects.

Another object of this invention is to provide a necklace of the character described, wherein the annular members have predetermined inner and outer edge configurations in accordance with desired designs and ornamental effects; the annular members being pierced to pass stringing means therethrough; the stringing means also carrying the beadlike elements to dispose the same within the annular members or externally of the annular members and between successive members.

Yet another object of this invention is to provide a necklace of the character described wherein the annular members are in two groups and individual members of the groups are so disposed as to leave edge portions of successive members in overlapping relation.

A further object of this invention is to provide a necklace of the character described, wherein the annular members are of a flat configuration, with the members of one group lying in one plane and the members of the other group lying in a second plane parallel to the one plane.

Still another object of this invention is to provide a necklace of the character described wherein the beadlike elements are so disposed within and between selected annular members so that different ornamental effects may be attained depending on which side of the necklace is exposed when worn.

Still a further object of this invention is to provide a necklace of the character described wherein a single set of one or more beadlike elements are disposed within the successive annular members of one set of such members; while a single set of one or more beadlike elements are disposed within the successive annular members of the other set of such members, together with still another set of one or more beadlike elements being disposed between successive annular members of one of the sets of such annular members and overlying the beadlike members within one of the sets of annular members, to thereby provide varied and alternative decorative effects.

Yet a further object of this invention is to provide a necklace of the character described, wherein means is provided for movably interconnecting the overlapping edge portions of successive annular members; threading means extending through threading passages in the annular members for mounting thereon beadlike elements disposed within each of the annular members; and optionally, providing second threading means extending through threading passages in selected successive annular members for mounting thereon beadlike elements between the selected successive annular members.

Another object of this invention is to provide a necklace of the character described, wherein the annular members have inner and outer edges of selected geometric configuration and being preferably flat; the annular members having opposed threading passages.

Other objects of this invention will in part be obvious and in part hereinafter pointed out.

DESCRIPTION OF THE PREFERRED EMBODIMENTS

Essentially, the ornamental necklace of the instant invention is made up of annular members and beadlike members. The annular members have inner and outer edges of varied and selected geometrical configurations; opposed portions of each of the annular member being pierced to provide aligned threading passages.

The beadlike members in their strung condition are arranged for disposition within each of the annular members. Further, the annular members are so arranged by virtue of the threading procedure, as to locate successive annular members with marginal portions thereof in overlapping relation.

Also, other beadlike members are disposed between adjacent, spaced annular members; such beadlike members also being in overlying relation to beadlike members within the annular member overlapping the adjacent spaced annular members.

Figure 1:
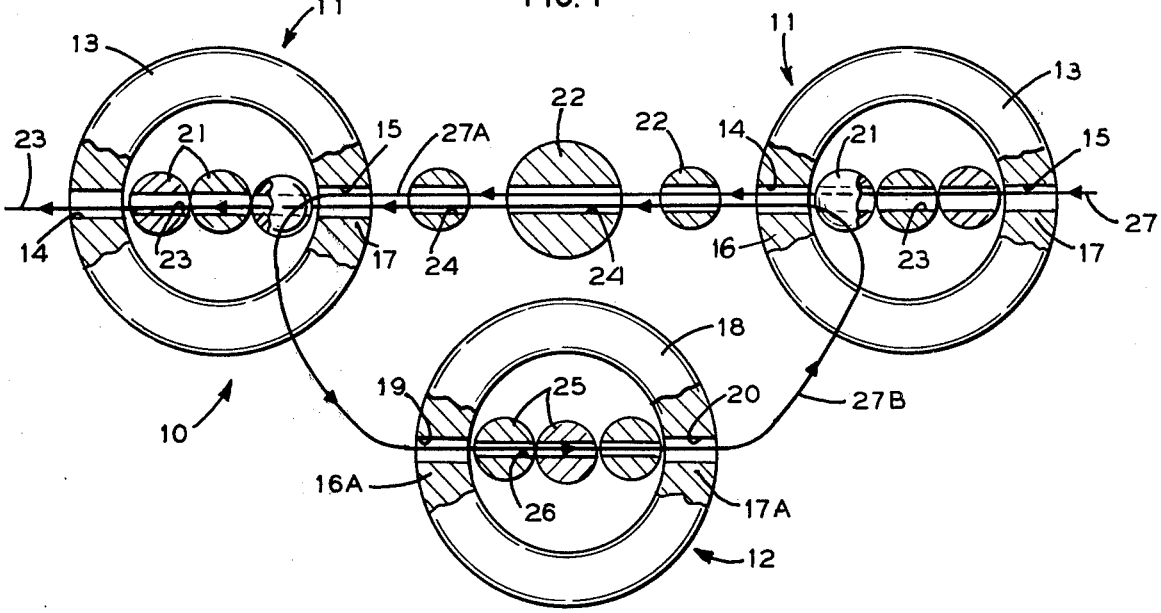
FIG. 1 is a plan view of an ornamental necklace embodying the invention; showing two groups of annular members and two groups of beadlike members in threaded relation to the annular members and in their preliminary relation to each other.
Figure 2:
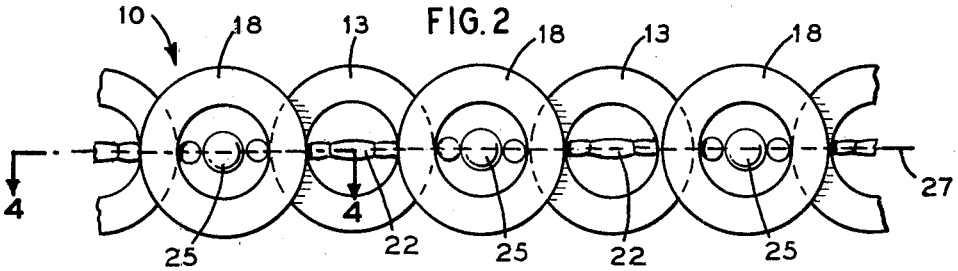
FIG. 2 is top plan view of the necklace in its final condition.
Figure 3:
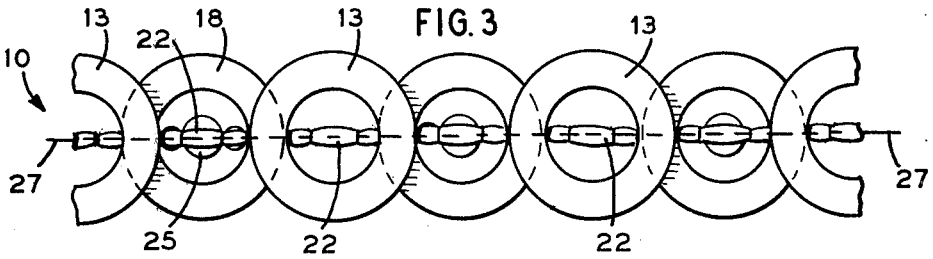
FIG. 3 is a bottom plan view of the necklace in its final condition.
Figure 4:
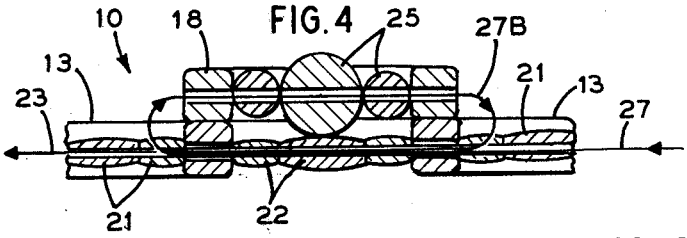
FIG. 4 is a sectional view taken on the line 4—4 in FIG. 2.

As shown in FIG. 1, a necklace embodying the invention is generally indicated at 10; the several elements thereof being shown in their preliminary, loosely strung arrangement and prior to their final strung condition.

The necklace 10, of which only a portion thereof is illustrated, is made up of a first group 11 of flat annular members, shown as circular for the purpose of illustration; it being understood that the annular members may have inner and outer edges of varying configurations. A second group 12 of annular members similar to that of group 11, are indicated in offset relation to set 11.

Each of the members 13 of group 11 is formed with diametrically aligned stringing passages 14, 15 on opposed portions 16, 17 of the annular members. Similarly, each of the members 18 of group 12 is formed with diametrically aligned stringing passages 19, 20 on opposed portions 16A, 17A of the annular members.

The necklace 10 further includes beadlike members adapted to be strung in such a manner as to locate some of the beadlike members within the annular members, while other beadlike members are located between annular members and in overlying relation to beadlike members within annular members.

Thus, beadlike members 21 are disposed within each of annular members 13 and beadlike members 22 are disposed between annular members 13 and in overlying relation to beadlike members 25, with the necklace 10 in its final condition. The members 21 are diametrically pierced as at 23, while members 22 are pierced as at 24. Further, beadlike members 25, pierced as at 26, are disposed within each of annular members 18.

It is understood that the relative disposition of annular member 13 and 18 and the location of beadlike members 21, 22 and 25, are determined by the mode of stringing.

Thus, a single continuous strand 27 of nylon or other suitable material, is threaded in the direction from right to left, looking at FIG. 1. The strand 27 is passed through the passage 15 of the right hand member 13, then through beadlike members 21 by way of threading passages 23. The strand 27 then continues through passage 14 of said right hand member 13 and thereafter through beadlike members 22 by way of threading passages 24.

Strand portion 27A then passes through passage 15 of the left hand annular member 13 and thereafter through passage 19 of annular member 18 and through beadlike members 25 within annular member 18 by way of threading passages 26 and thereafter out through passage 20 in annular member 18.

The strand portion 27B then passes through passage 14 of the right hand annular member 13, thereafter through beadlike members 22, through passage 15 of left hand annular member 13, through beadlike members 21 and out through passage 14 of the left hand annular member 13. It is understood that the thus described threading procedure is continued through further beadlike members 13 and 18 to attain a desired length of necklace. The usual clasps or catches are applied to the terminal ends of the strung annular members and beadlike members.

It will be apparent that when the strand 27 is pulled taut at the end of the stringing operation, annular members 18 will be automatically moved so that each of the annular members 18 will have marginal portions thereof lying in overlapping relation to marginal portions of annular members 13. Further, beadlike members 25 will overlie beadlike members 22. In all cases, strand 27 will be concealed from view.

Obviously, the beadlike members 21 and 25 may be of any selected number, color, configuration, or the like. However, such number and diametrical dimension is such as to completely conceal otherwise exposed portions of strand 27. It follows that necklace 10 may be worn on either side to provide alternative decorative effects.

Figure 5:
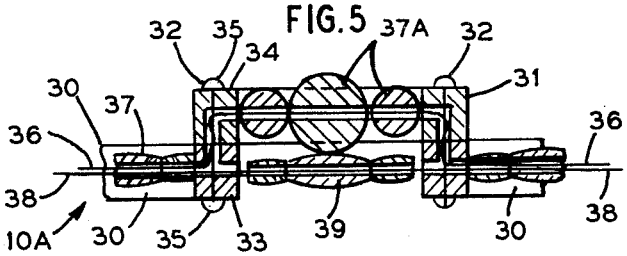
FIG. 5 is a sectional view showing another embodiment of the invention.

Another embodiment of the novel necklace construction of the instant invention, is shown in FIG. 5. Here, necklace 10A is made up of one set of annular members 30 in spaced relation and another set of annular members 31, wherein the diametrically disposed marginal portions of annular members 31 overlap marginal portions of annular members 30.

The annular members 30, 31 are movably interconnected by swivel pins 32 extending transversely of the overlapped marginal portions 33, 34 of said members 30, 31. The pins 32 are headed as at 35. A single strand 36 locates beadlike members 37, 37A within the annular members 30, 31; said strand passing through threading passages in annular members 30, 31, as previously described.

Optionally, a second strand 38 may be used to locate beadlike members 39 between annular members 30 and to dispose said beadlike members 39 in opposed relation to beadlike members 37A. Strand 38 passes through the passages in annular members 30 only.

Again, beadlike members 37, 37A and 39 are of a number and size to conceal the supporting strand portions. The configuration and color of the beadlike members may be varied to attain desired ornamental effects. Necklace 10A may also worn optionally on either side to achieve varied ornamental effects.

I claim:

1. An ornamental necklace comprising a first group of linearly aligned spaced annular members and a second group of linearly aligned spaced annular members, said groups being laterally positioned with respect to each other, each annular member of the first group of annular members having portions thereof in overlapping relation to portions of a respective pair of annular members of the second group of annular members, each of the annular members being formed with aligned threading passages, means movably connecting the overlapping portions of each pair of adjacent annular members, threading means passing through the threading passages of said annular members, and a plurality of beadlike members strung on those portions of said threading means extending between said passages and concealing said threading means.

2. A necklace according to claim 1 wherein said beadlike members include first selected beadlike members disposed within the annular members of one of said groups of annular members, and second selected beadlike members disposed within the annular members of the other group of annular members.

3. A necklace according to claim 2 which further includes third selected beadlike members disposed between the annular members of one of said groups of annular members.

4. A necklace according to claim 3 wherein said third selected beadlike members overlie beadlike members within an annular member.

5. A necklace according to claim 1 wherein said connecting means comprises pin members passing through the overlapping portions of each pair of adjacent annular members and in transverse relation to said overlapping portions of the annular members.

6. A necklace according to claim 1 wherein said annular members are of a flat configuration.

7. A necklace according to claim 6 wherein said annular members are circular.

8. A necklace according to claim 7 wherein the annular members of one of said groups of annular members are disposed in one plane and the annular members of the other group of annular members are disposed in another plane parallel to the first plane.

* * * * *